United States Patent [19]

Magerowski et al.

[11] Patent Number: 4,956,078

[45] Date of Patent: Sep. 11, 1990

[54] FEED PRESTRATIFICATION ATTACHMENT FOR HIGH EFFICIENCY VIBRATORY SCREENING

[75] Inventors: Anthony J. Magerowski, Milwaukee; Vijia K. Karra, Greendale; Scott E. Szalanski, Oak Creek; John A. Gieschen, West Allis, all of Wis.

[73] Assignee: Nordberg Inc., Milwaukee, Wis.

[21] Appl. No.: 304,188

[22] Filed: Jan. 30, 1989

[51] Int. Cl.[5] ..... B07B 1/46

[52] U.S. Cl. ..... 209/254; 209/243; 209/263; 209/315; 209/395; 209/674; 403/379; 403/362

[58] Field of Search ..... 209/254, 314, 315, 393, 209/395, 396, 234, 674, 263, 264, 266, 243; 403/378, 379, 362, 320

[56] References Cited

U.S. PATENT DOCUMENTS

| | | | |
|---|---|---|---|
| 104,799 | 6/1870 | Vandegrift | 209/314 X |
| 660,784 | 10/1900 | Wowra | 209/234 |
| 1,164,161 | 12/1915 | Ayers | 403/379 |
| 1,351,563 | 8/1920 | Gaskill | 209/295 |
| 2,764,292 | 9/1956 | Austin, Sr. | 209/421 |
| 3,105,816 | 10/1963 | Hayden et al. | 209/331 |
| 3,106,253 | 10/1963 | Couture | 209/325 |
| 3,278,029 | 10/1966 | Binnix | 209/393 X |
| 3,347,368 | 10/1967 | Mogensen | 209/674 X |
| 3,622,089 | 11/1971 | Quinn | 241/75 |
| 3,900,392 | 8/1975 | Speno et al. | 209/241 |
| 3,954,604 | 5/1976 | Krauss et al. | 209/325 |
| 3,971,716 | 7/1976 | Foreman | 209/396 |
| 4,250,024 | 2/1981 | Soares | 209/10 |
| 4,361,240 | 11/1982 | Davis et al. | 209/674 |
| 4,572,782 | 2/1986 | Smith et al. | 209/236 |

FOREIGN PATENT DOCUMENTS

| | | | |
|---|---|---|---|
| 333317 | 6/1903 | France | 209/315 |
| 845875 | 7/1981 | U.S.S.R. | 209/315 |
| 1375356 | 2/1988 | U.S.S.R. | 209/396 |

OTHER PUBLICATIONS

"The 'WAG' Action of Spring Steel Rods Makes the Difference of the New ROD-Vib", Midwestern Industries Inc., Massillon, Ohio, Form No. 212, 4 pages, no date.

"Heavy Duty and Extra Heavy Duty GP Screens-Nordberg", Rexnord Inc., Milwaukee, Wisconsin, Bulletin 465A, Jun. 1985, 12 pages.

*Primary Examiner*—Donald T. Hajec

*Attorney, Agent, or Firm*—Welsh & Katz, Ltd.

[57] ABSTRACT

A feed prestratification attachment for classifying materials is configured to be secured to a vibrating screen unit so as to encourage stratification and more even distribution of the incoming feed material. The attachment includes a pair of side adapter plates separated by a horizontal mounting bar and a plurality of elongate rods affixed at one end to the mounting bar, the rods dimensioned so that the vibratory movement of the vibrating screen causes the rods to oscillate, thus permitting the rapid passage of undersize particles through the rods and the presentation of those particles to the screen, and enhancing the stratification of near-size and oversize particles.

14 Claims, 3 Drawing Sheets

FEED PRESTRATIFICATION ATTACHMENT FOR HIGH EFFICIENCY VIBRATORY SCREENING

BACKGROUND OF THE INVENTION

This invention relates to screening devices used to classify particulate material, and specifically relates to a feed prestratification attachment to be mounted upon a conventional vibrating screen unit.

A vibrating screen unit is a device which accomplishes the separation of a source of particulate feed material into various size classes. This classification is accomplished by feeding the material to the unit, which is vibrating in a controlled reciprocating manner in a vertical plane, so that particles which are fed thereto are repeatedly thrown upward, and, upon falling, the finer particles pass through at least one deck of screening surface containing apertures for passage of smaller, undersize, particles. The larger, oversize, particles are retained upon the upper deck of screening surface. The screening surfaces are arranged so that the uppermost deck is provided with the largest screen openings and the lowermost deck is provided with the smallest openings.

A counterweight shaft apparatus induces the vibrating action to the screen unit and provides it with a specified amplitude and frequency. The amplitude induces the upward motion to the layer of feed material deposited upon the uppermost deck of screening surface. This upward motion lifts the feed particles away from the screening surface to allow the layer of material to rearrange itself before falling back upon the screening surface for separation. This rearrangement of particles is known as stratification. Ideally, through the stratification process, the oversize particles move to the top of the layer and the undersize particles move to the bottom to be presented to the screening surface for separation. The oversize particles also act to push the close-to-aperture, near-size, particles through the screening surface. Once separated, the classified particles are separately fed in conventional fashion to conveyors or collecting hoppers.

A common problem of conventional vibratory screen units is that the feed material tends to heap upon the uppermost end of the top screening surface, thus creating a bed of material which is too thick to permit proper stratification. Even the vibration of the screen unit will not permit efficient stratification of that heaped material and the desired presentation of undersize particles to the screening surface for classification.

One attempted solution is to increase the amplitude of the unit so that the heaped particles are thrown higher, allowing more time for better stratification. Unfortunately, as amplitude is increased, frequency has to be decreased. A significant consideration here is that screen units are designed with certain speed and amplitude parameters to achieve an acceptable acceleration force level, Ag.

At lower speeds, the particles will be presented to the screening surface a lesser number of times. This will decrease capacity, as undersize particles are provided with less opportunities to pass through the screening surface. The lower the amount of separation of undersize particles in the feed, the lower is the screening efficiency.

In an attempt to solve this problem of "heaping" of feed material, supplemental feed stratification units known as "grizzlies" have been provided. These grizzlies generally consist of a static or fixed screening surface positioned above the feed end of the screen unit to assist in the stratification of feed material. A common drawback of these static grizzlies is that the heaping of feed material is only transferred from the screen deck to the grizzly itself. Thus, the stratification of the feed material is still not enhanced significantly, and the undersize particles may still be prevented from contacting the screen apparatus by oversize and near-size particles.

Thus, there is a need for a prestratification screening device which allows incoming feed material to be stratified prior to its introduction upon the screening surface. In addition, there is a need for a screen attachment which will allow the conventional screen unit to be operated at optimum speed and amplitude parameters to enhance screening capacity and efficiency without exceeding the designed Ag force level. Another problem associated with the heaping effect is the uneven distribution of the feed material across the width of the screening surface. Therefore, a feed prestratification attachment should also provide a more even distribution of the feed material across the screening surface. Lastly, there is a need for a prestratification screen attachment which may be mounted upon any conventional type of vibrating screen unit.

SUMMARY OF THE INVENTION

Accordingly, a feed prestratification attachment is provided which is designed to be mounted to vibrating screen units of various manufacture, near the feed end thereof. The attachment of the invention is positioned to intercept the flow of feed material to the screen unit, thus preventing heaping at the feed end, providing initial and more rapid stratification and dispersing the feed material evenly across the screen surface.

More specifically, the stratification deck of the invention includes a pair of inclined, spaced, parallel side adapter plates designed to be mounted to respective sidewalls of a vibrating screen unit at the feed end thereof. An elongate member having rod mounting apertures is mounted between the plates on a substantially horizontal plane. A plurality of elongate rods, each of which being mounted at one end to the elongate member, are disposed in parallel spaced relationship to each other so that opposite free ends thereof project over the feed end and feed zone of the screening surface and terminate above a middle portion of the screening surface known as the stratified screening zone. The rods are provided in a specified length and diameter so that vibrating motion of the screen unit initiates a vibration of the rods, which prestratifies the feed material, as well as aids in the distribution of the feed material across the screening surface. In addition, the length of the rods, their diameter and the angle at which the rods are situated in relation to the angle of the screening surface are designed so that incoming feed is separated initially into the undersize particles, which pass through the rods and onto the screening surface, and a combination of the near and oversize particles, which are stratified on the rods and deposited, in stratified form, upon the screening surface, after exiting the attachment. These deposited oversize particles apply a downward pressure on the near and undersize particles to further facilitate their passage through openings in the screening surface. The positioning of initially separated undersize particles, as well as the near and undersize particles, in the feed and stratified screening zones, respectively, closer to the screen apertures enhances the overall capacity and efficiency of the screen unit.

DESCRIPTION OF THE PREFERRED EMBODIMENT

Figure 2:
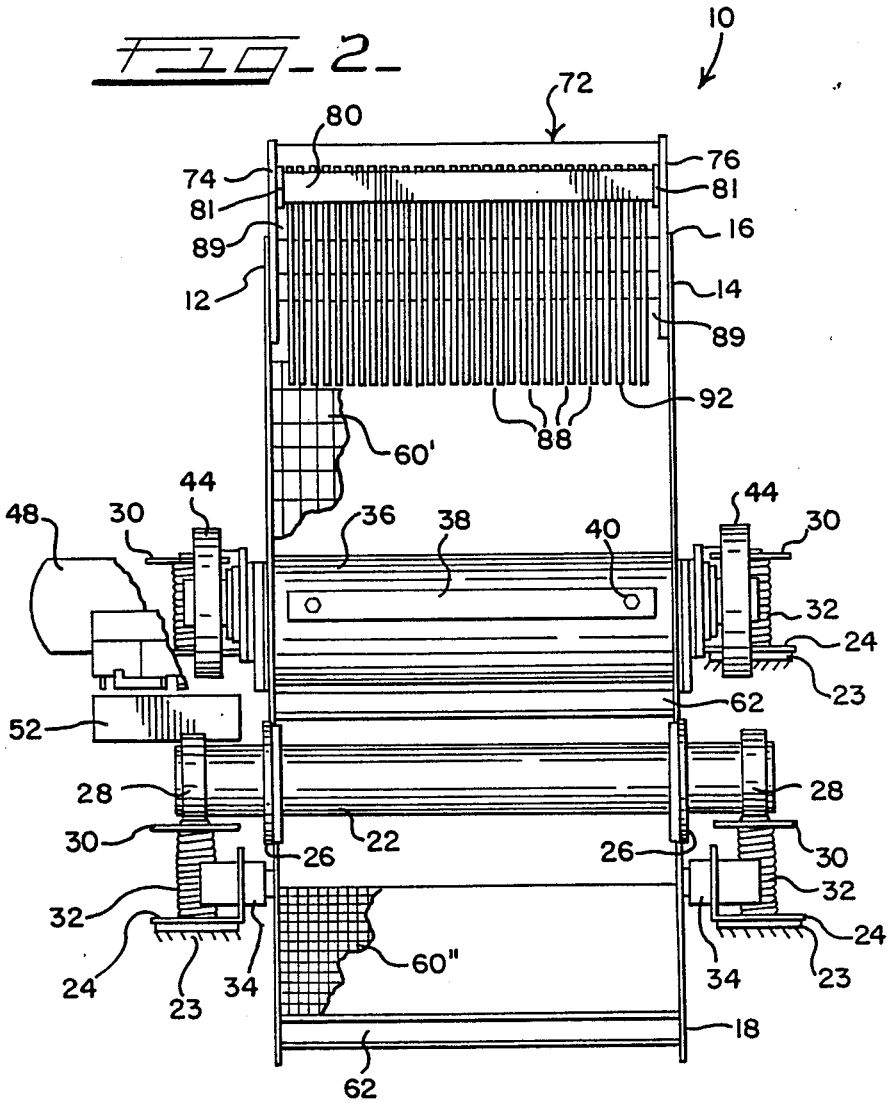
FIG. 2 is a front elevational view of the screen unit and feed prestratification attachment of the invention taken along the line 2—2 of FIG. 1 and in the direction generally indicated, with portions broken away for clarity.

Referring now to the drawings, wherein like reference numerals identify identical features, an inclined vibrating screen unit is generally designated 10. The unit 10 includes a pair of sidewalls 12 and 14 which are disposed in spaced parallel relationship to each other and are each provided with an upper or feed end 16 and a lower end 18. The sidewalls 12, 14 are separated by two heavy duty tubes or pipes 20 and 22 which pass therethrough and join both sidewalls 12, 14 to provide four corner supports for mounting the screen unit 10 upon a support structure 23. Four base plates 24 rest upon the support structure 23 and are preferably bolted or welded thereto. Each of four rings 26 is disposed around a corresponding end of pipes 20, 22 and is huck fastened to the respective sidewall to equally distribute the load to the pipes and to add rigidity to the vibrating unit 10. The pipes 20, 22 may also be used for lifting the screen unit 10. The pipes 20, 22 are provided with a pivot bracket 28 at each end thereof having a lower edge margin defining an upper spring seat 30, and the base plates 24 define a lower or bottom spring seat. Heavy duty coil springs 32 are mounted between the pivot brackets 28 and the base plates 24. A spring loaded friction check assembly 34 (best seen in FIG. 2) is mounted adjacent to the sidewalls 12, 14 near end each of the pipes 20, 22 and closely adjacent to the pivot brackets 28 to minimize the stroke during starting and stopping of the unit 10 and also to laterally stabilize the screen during operation.

A vibrator shaft 36 is centrally located between the two sidewalls 12, 14, being positioned approximately mid-way between the upper and lower ends 16 and 18 respectively. The shaft 36 is provided with at least one counterweight 38 releasably attached thereto by bolts 40, which upon rotation of the shaft 36 in the direction indicated by the arrow 42, induce a vertical circular oscillating motion to the sidewalls 12, 14. Each end of the vibrator shaft 36 is proVided with a sheave 44 adapted to accommodate a V-belt 46 driven by a heavy duty electric motor 48 having a pulley wheel 50. The tension of the V-belt 46 is adjusted by altering the angular position of a motor base plate platform 52 which may be pivotally secured at a point 54 and which is adjustable by a spring loaded bolt 56 and slide rod 58.

At least one and preferably two to three sections of screening surface or cloth 60 are positioned between the sidewalls 12, 14. Each section of screening cloth 60 is secured upon a respective screen cloth support tray 62 which is rigidly secured to the sidewalls 12, 14. The sections of screen cloth 60 are releasably attached to the sidewalls 12, 14 and to the support trays 62 to enable the replacement of worn cloth 60. The number of screening surfaces 60 and the size of the screen mesh of each surface 60 is determined by the specific application of the unit 10. However, it is most common to have a more open mesh or larger openings on the upper screening surface 60', and a finer mesh or smaller openings on the lower screening surface 60''. The uppermost screening surface 60' of the screen unit 10 is referred to as having three general zones: a feed zone 64, a stratified screening zone 66 and a cleaning zone 68.

In operation, the rotation of the counterweighted vibrator shaft 36 by the motor 48 induces a vertical circular motion of the unit 10 upon its support structure 23. The amplitude or throw of the screen 10 may be adjusted by altering the position and number of the counterweights 38 upon the shaft 36. The speed or frequency of vibration may be adjusted by altering the diameter of the pulleys 50 and/or the sheave 44.

Figure 1:
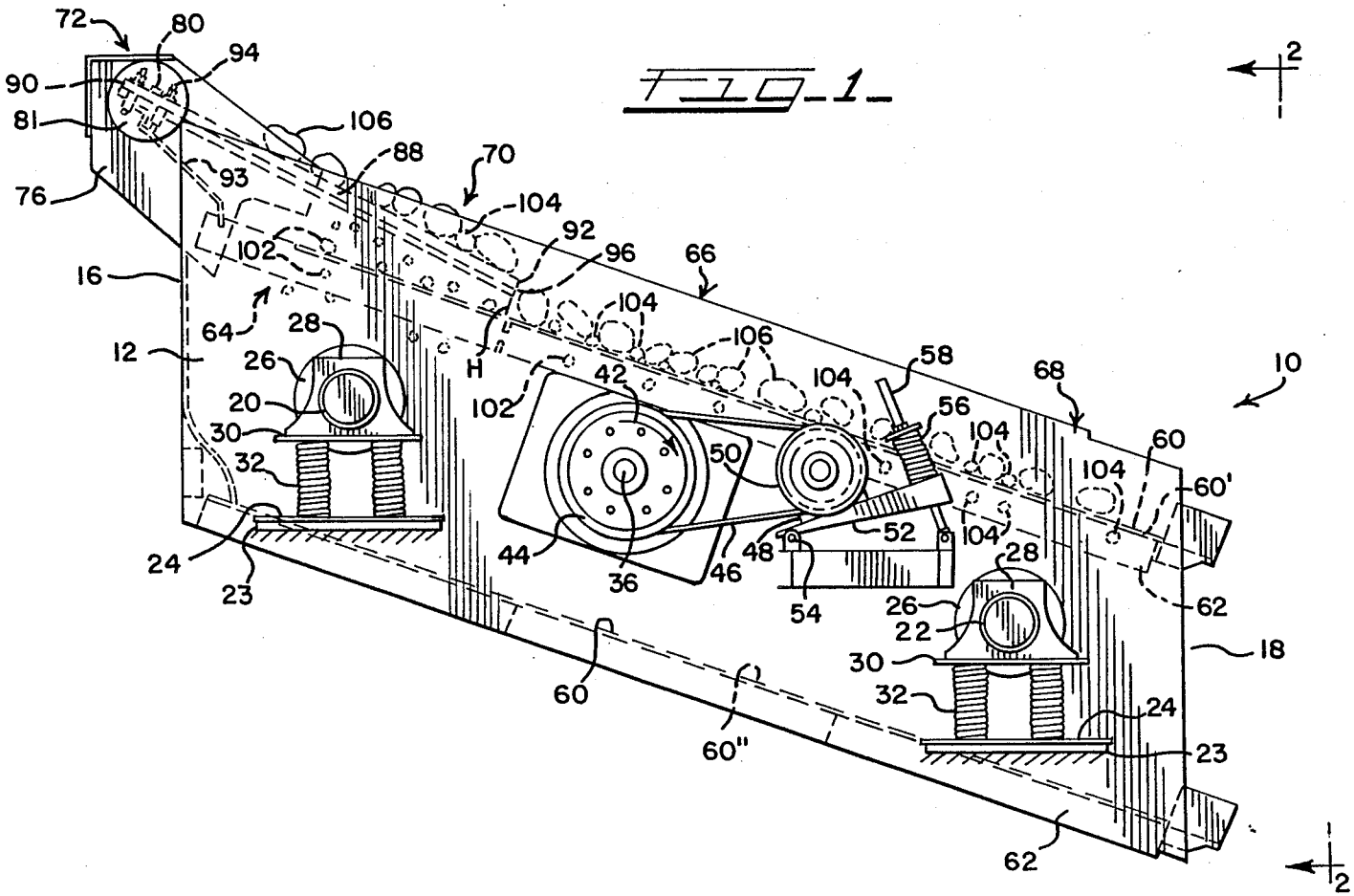
FIG. 1 is a side elevational view of a screen unit to which is mounted the feed prestratification attachment of the invention, with portions shown broken away for clarity.
Figure 3:
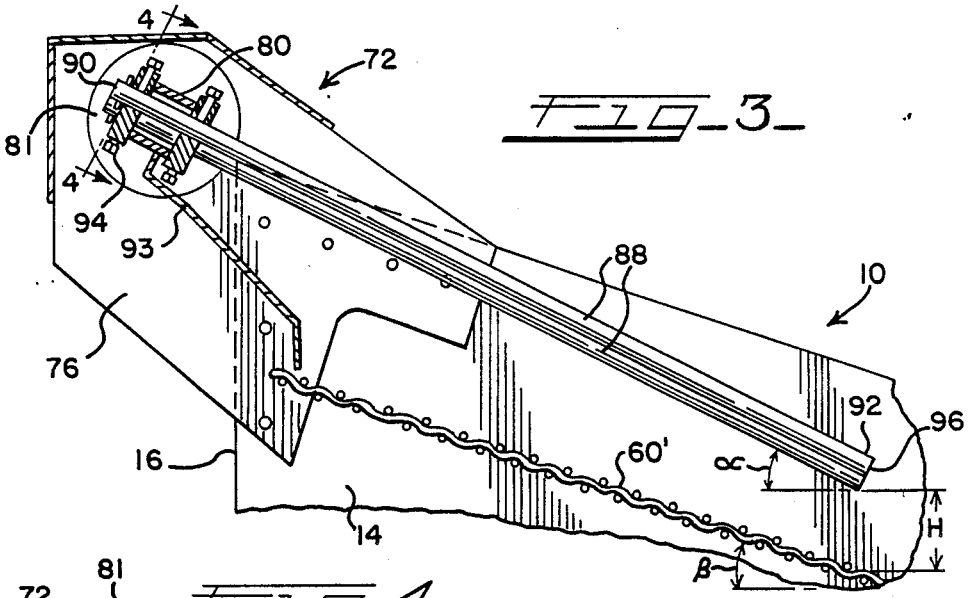
FIG. 3 is a side elevational view of the feed prestratification attachment shown in FIG. 1 with portions broken away for clarity.
Figure 4:
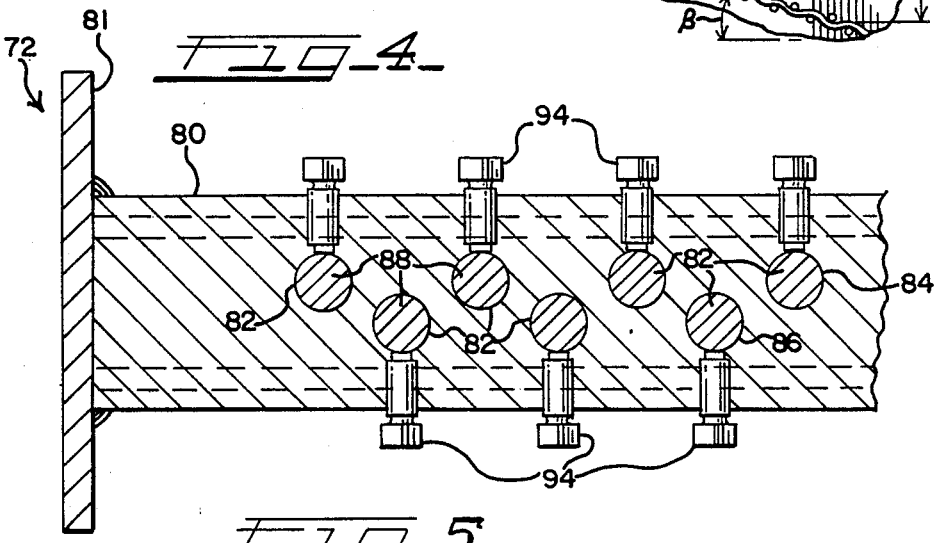
FIG. 4 is a fragmentary sectional elevation along the line 4—4 of FIG. 3 and in the direction generally indicated.

Referring now to FIGS. 1–4, the feed prestratification attachment of the invention is depicted and is designated generally 72. The attachment 72 is provided with a pair of adapter side plates 74 and 76 (only plate 76 is shown in FIGS. 1 and 3), each of which is provided with adequate fastener apertures 78 to permit installation upon screen units 10 produced by various manufacturers. The adapter plates 74 and 76 may be fastened at the feed end 16 to the sidewalls 12, 14 of the unit 10 either by bolting, by the use of huck fasteners or by welding. The adapter plates 74, 76 are separated by an elongate rod support member or beam 80 having a flange 81 at each end, which is secured, as by bolting or welding, to the adapter plates 74, 76, the beam 80 being positioned on a substantially horizontal plane. The beam 80 is provided with a plurality of throughbore openings 82 (best seen in FIG. 4). The throughbores 82 are disposed upon the beam 80 in preferably staggered arrangement in an upper row 84 and a lower row 86.

A plurality of elongate rods 88 are provided, each rod being fabricated of steel or suitably resilient alloy and having a mounting end 90 and a free or discharge end 92. The rods 88 are provided with a diameter which allows them to be matingly inserted into and through the throughbores 82. The mounting ends 90 of the rods 88 are secured within the throughbores 82 by at least one and preferably two set screws 94. Each rod 88 is provided with a length such that the discharge end 92 extends to a point 96 above the stratified screening zone 66. It will be evident from the configuration of the rods 88 and their mounting to the beam 80 that upon vibration of the screen unit 10, a certain oscillation will be easily induced. The degree of oscillation will depend on the length and diameter of the rods 88. It is preferred that a gap 89 (best seen in FIG. 2) be defined between the rods 88 and the adapter plates 74, 76 to permit access to the screening surface 60 for repair or replacement purposes.

The diameter and length of individual rods 88 are determined in part by the available space between the adapter plates 74, 76, but also by the desired wear life and the rods' vibratory response. As used herein, the term "rod vibratory response" or "rod natural frequency" refers to the behavior of each of the rods 88 due to external tactile stimuli which may effect rigidity, and includes the inertia and stiffness of the rod 88 itself, as well as the inertia and stiffness of the beam 80 upon which the rod is mounted. For a given support beam 80 and rod 88 application, each combination of rod diameter and length has a particular natural frequency, which increases as the diameter increases, and also as length increases. When the rod's natural frequency is near the operating frequency of the screen, an undesirable resonance results, where the rod's motion and operating stresses would be dangerously amplified. However, rod motion and stress decrease progressively as the rod's natural frequency is chosen to be dissimilar to, i.e., either higher or lower than, the screen's operating frequency.

While the fully resonant condition is to be avoided, some amplification of motion (i.e., rod motion greater than the motion of the screen) is desirable to minimize the tendency of particles to become wedged between rods and thus obstruct material flow through the screen. In the present device 72, the diameter of the rods 88 is selected so that the natural frequency of the rod vibration provides a degree of motion amplification and at the same time is dissimilar enough from the screen's operating frequency to avoid excessive operating stress and consequent early fatigue failure in the rods.

The rod mounting throughbores 82 are positioned in the beam 80 so that the rods 88 which are positioned therethrough are disposed at an angle relative to the horizontal which is greater than or approximately equal to an angle B of the screening surface 60 (best seen in FIG. 3). This condition promotes rapid spreading of feed material 70 from the rods 88 to the screening surface 60. In addition, the angle o of the rods 88 is such that the discharge or free end 92 thereof is at a specified height H (best see in FIG. 3) above the uppermost screening surface 60' for optimum placement of the near and oversize material 104, 106, respectively thereupon.

To aid in the even distribution of feed material 70, and also to enhance the stratification process, the throughbores 82 are disposed in a staggered pattern in the beam 80 so that when rods 88 are inserted therein, an irregular or waved separation surface to the incoming material is presented. The undersize particles pass the upper row 84 of rods 88 with little or no resistance so that undersize particles may then be presented to a second row 86 of rods 88 and then upon the screening surface 60' for more rapid separation. A deflecting plate 93 is disposed to retain undersize particles within the unit 10.

Figure 5:
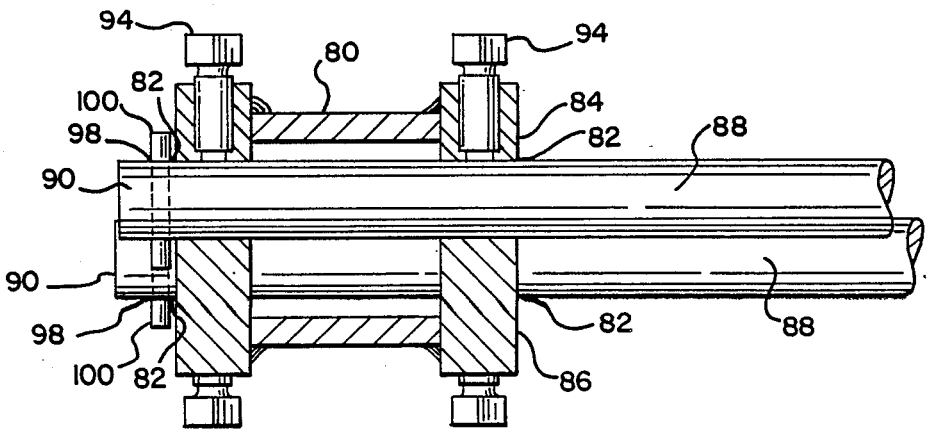
FIG. 5 is a vertical sectional elevation of a portion of the attachment of the invention, showing the details of the mounting end of the elongate rods and their attachment to the mounting member.

Referring now to FIG. 5, in some applications, it may be desired to provide the rods 88 with additional fasteners to prevent the rods from falling out of the rod support beam 80 if the set screws 94 should become loose through the vibrations inherent with extended operation. In this embodiment, the mounting end 90 of each of the rods 88 is provided with a transverse opening 98 which is dimensioned to accommodate a taper pin 100 which is hammered or forced therein. The taper pins 100 are dimensioned to allow removal for replacement of rods 88 when necessary. In applications of the attachment 72 to various screen units 10, if an installation does not permit sufficient clearance for removal of the rods 88 from the upper end 16, the pins 100 may be removed and the rods 88 removed from the lower end 18.

In operation, and referring now to FIG. 1, a source of feed material 70 is introduced upon the rods 88 of the feed prestratification attachment 72. The motion of the screen unit 10 causes vibration of the rods 88 of the feed prestratification attachment 72. Through this action, finer particles 102 are allowed to pass through the attachment 72 and be presented to the upper screening surface 60' of screening cloth 60 to pass therethrough. The vibrating motion of the rods 88 also provides initial stratification of the near and larger-sized fractions 104, 106, respectively of the feed material 70, and the length of the rods 88 is designed to distribute the feed material 70 upon the stratified screening zone 66 of the screening surface 60.

In the feed zone 64, the amplitude of the screen unit 10, created by the action of the rotating vibrator shaft 36, provides an upward motion to the bed of material 70 being separated and repeatedly lifts the bed away from the screening surface 60' to allow the bed to rearrange itself before it falls back to the screening surface for separation. During this rearrangement or stratification, the movement of oversize material 106 to the top, and undersize 102 and near-size 104 material to the bottom of the bed allows the undersize and near-sized particles to be presented to the screening surface 60' for separation. The oversize particles 106 exert downward pressure on the smaller particles 102 and 104, thus pushing them through the screen apertures.

The feed prestratification attachment 72 is so designed to allow quick passage of undersize 102 and some near-size material 104 for presentation to the uppermost screening surface 60'. Oversize material 106 and the remaining near-size material 104 are retained on the feed prestratification attachment 72 and fall upon the screening surface 60' in the stratified screening zone 66. The undersize particles 102 that are of a size less than 0.5 of the aperture will rapidly pass through the apertures of the screening surface 60 with little or no resistance, thus providing a larger portion of the screen surface area to the more difficult task of the passage of near-size particles 10 and the undersize particles 102 in the size range of 0.5 to 1.0 of the screen aperture. The majority of this latter operation occurs in the stratified screening and cleaning zones 66, 68, respectively, of the screening surface 60'.

It has bee n found that the feed prestratification attachment 72 of the invention evenly distributes the feed material and allows the screen unit 10 to perform its principal duty of separation in the feed zone 64 of the screen. Thus, the diameter of screen wire used on the screening surface 60' may be smaller due to the lower amount of material that surface has to handle, as well as to the absence of larger particles which normally would increase the wear of the screening surface. Furthermore, by reducing the wire size of the screening surface in the zone 64, a larger open area results, which facilitates the passage of undersize particles 102 and near-size particles 104 therethrough. The efficiency of the screen unit 10 is accordingly increased.

Screen efficiency is also increased when the feed prestratification attachment 72 is so designed that when attached to a screen unit 10 it will have a larger amplitude than the screen unit. This allows the screen unit 10 to be operated at a smaller amplitude (i.e., with a smaller throw) than that required for conventional stratification of a given feed material without the attachment 72. At a smaller throw, the screen unit 10 may be operated at a higher frequency or speed, which will increase the number of times the layer of material is presented to the screening surface 60' for separation. With an increase in the number of times the undersize particles are presented to the screening surface, the probability that those particles will pass therethrough accordingly increases. Also, when the probability of passage of the undersize and near-size material 102, 104 respectively is increased, the efficiency and capacity of the screen unit 10 is also increased.

In quantitative terms, this relationship may be expressed by the formula:

$$Ag=0.00001419\ T\ N^2$$

where

Ag=acceleration in units of gravity

T=screen throw (inch)

N=screen frequency (RPM)

Conventional screens are designed to have a maximum "Ag" value of approximately 3.5, beyond which component failure is likely to occur. With an Ag value of 3.5 in the formula, it is evident that a decrease in the throw value T will result in a corresponding increase in the maximum allowable frequency N. It has been found that when the feed prestratification attachment 72 is fastened to a conventional screen unit 10, the throw may be reduced from 10 to 50% and the speed may be increased from 10 to 60%.

Thus, the feed prestratification attachment of the invention, when used in combination with a conventional screen unit, increases screen productivity by stratifying the feed material early in the screening cycle, enhancing the distribution of material onto the screening surface, reducing the heaping of the feed material in the feed zone of the screen, all of which are performed in a relative short distance near the feed end of the screen to allow greater space and process time for efficient classification. The use of the attachment of the invention allows the screen throw to be reduced, thus allowing for an increase in screen speed and an attendant increase in capacity.

While a particular embodiment of the feed prestratification attachment of the invention has been shown and described, it will be appreciated by those skilled in the art that changes and modifications may be made thereto without departing from the invention in its broader aspects and as set forth in the following claims.

We claim:

1. A feed prestratification attachment for mounting to a vibrating screen unit having a self-induced vibrating action and vibrating at a specified operating frequency, a feed end and at least one generally planar screening surface rigidly secured to the unit, said attachment comprising:

a pair of side adapter plates disposed in spaced parallel relationship to each other, each said plate having plate mounting means for mounting said attachment to the screen unit;

a single elongate member located between said adapter plates on a generally horizontal plane substantially perpendicular to said plates, said member having rod mounting means; and a plurality of elongate vibratable rods, each of which being provided with a mounting end and a discharge end, said mounting ends being configured to engage said mounting means so that said rods project in spaced parallel relationship from said elongate member, each of said rods having a specified length and diameter, said rod length and diameter being specified so that upon the vibration of said rods, feed material deposited on said rods will be preliminarily stratified and distributed between said rods and from said discharge end evenly across the screening surface, said attachment having no means of inducing said vibration of said rods, said vibration being induced through the vibratory action of the screen unit.

2. The feed prestratification attachment as defined in claim 1 wherein said rod mounting means is a plurality of staggered throughbores in said elongate member.

3. The feed prestratification attachment as defined in claim 1 wherein said mounting ends of said rods pass through said member.

4. The feed prestratification attachment as defined in claim 2 wherein said rods are retained within said bores by set screws.

5. The feed prestratification attachment as defined in claim 4 wherein each of said rods is provided with a transverse opening at said mounting end and is further retained within said bores by a taper pin passing through said opening.

6. The feed prestratification attachment as defined in claim 1 wherein said rods each oscillate at a natural frequency, said rods being configured so that said natural frequency of said rods is dissimilar to the operating frequency of the unit.

7. A combination vibrating screen unit and feed prestratification attachment, comprising:

a vibrating screen unit having a pair of spaced parallel sidewalls with at least one layer of screening surface securely mounted transversely therebetween;

said screen unit having a feed zone, a stratified screening zone, and a cleaning zone;

means mounted to said screen unit for inducing reciprocating vibrating motion to said unit;

a feed prestratification attachment secured to said unit and including:

a pair of spaced parallel side adaptor plates, each said plate having plate mounting means and being mounted by said plate mounting means to said sidewalls at said feed zone of said unit;

a single elongate member mounted between said plates on a substantially horizontal plane, said member having rod mounting means; and a plurality of elongate rods, each of which having a mounting end and a discharge end and being mounted at said mounting end to said rod mounting means of said elongate member, said rods being disposed in parallel spaced relationship to each other, said discharge ends of said rods being disposed above said stratified screening zone of said screening surface, each of said rods having a specified length and diameter for vibration at a natural frequency induced by said vibrating motion of said screen unit so that feed material deposited thereon will be preliminarily stratified on said rods, the material falling between said rods and being distributed from said discharge ends evenly across said screening surface.

8. The combination as defined in claim 7 wherein said screening surface is disposed at an angle relative to the horizontal.

9. The combination as defined in claim 8 wherein said rods are also inclined at an angle relative to the horizontal, said angle of inclination of said rods being greater than said angle of inclination of said screening surface.

10. The feed prestratification attachment as defined in claim 7 wherein said screen unit vibrates at a specified operating frequency and said rods each vibrate at a natural frequency, said rods being configured so that said natural frequency of said rods is dissimilar to the operating frequency of said unit.

11. A method of classifying a supply of particulate commutable material by size, comprising:

providing a vibrating inclined screen unit having a feed end, at least one deck of screening surface, and inducing vibratory motion to said screen unit at a specified operating amplitude and frequency;

attaching a feed prestratification attachment having a plurality of elongate vibratable rods to said feed end of said unit, said rods each having a free end and being configured to have a specified natural vibrational frequency;

inducing the vibration of said rods by the vibratory motion of said screen unit;

introducing a flow of the particulate material to said rods of said attachment so that oversize and some near-size particles are temporarily retained on said attachment, and undersize and remaining near-size particles pass through said rods to fall evenly upon and through said screening surface; and discharging the near-size and oversize particles from the free end of said attachment rods to fall evenly upon said deck of screening surface, the oversize particles covering the near-size and any remaining undersize particles and acting to assist in the forcing of near-size and undersize particles through said deck of screening surface.

12. The method as defined in claim 11 including providing said screen unit with multiple decks of screening surface.

13. The method as defined in claim 11 further including providing said rods with a natural frequency which is dissimilar to said frequency of said unit.

14. A feed prestratification attachment for mounting to a vibrating screen unit having a feed end, at least one generally planar screening surface, and, during operation, vibratable at a specified operating frequency, said attachment comprising:

a pair of side adapter plates disposed in spaced parallel relationship to each other for mounting said attachment to the screen unit;

an elongate member located between said adaptor plates on a generally horizontal plane substantially perpendicular to said plates, said member having rod mounting means;

a plurality of elongate rods, each of which being provided with a mounting end and a discharge end, said mounting ends being configured to engage said mounting means so that said rods project in spaced parallel relationship from said elongate member, each of said rods having a specified length and diameter so that feed material deposited thereon will be preliminarily stratified and distributed evenly across the screening surface; and said rods each vibratable at a natural frequency, said rods being configured so that said rod natural frequency is dissimilar to the operating frequency of the unit.

* * * * *